United States Patent [19]

Gordon

[11] 4,417,664

[45] Nov. 29, 1983

[54] METHOD AND APPARATUS FOR MOUNTING LIFT CRANE ON OFFSHORE STRUCTURES

[75] Inventor: John C. Gordon, Jefferson, La.

[73] Assignee: Nautilus Crane & Equipment Corporation, Reserve, La.

[21] Appl. No.: 288,978

[22] Filed: Jul. 31, 1981

[51] Int. Cl.[3] ..... B66C 23/52

[52] U.S. Cl. ..... 212/192; 405/196; 405/200; 212/190

[58] Field of Search ..... 212/190, 192, 193, 194, 212/259; 405/196–200

[56] References Cited

U.S. PATENT DOCUMENTS

| | | | |
|---|---|---|---|
| 1,551,768 | 9/1925 | Otis | 212/253 |
| 1,706,441 | 3/1929 | Daughs | 212/192 |
| 4,011,955 | 3/1977 | Morrow, Sr. et al. | 212/192 |
| 4,310,277 | 1/1982 | Robinson | 212/192 |
| 4,359,164 | 11/1982 | Triplett | 212/192 |

*Primary Examiner*—Trygve M. Blix

*Assistant Examiner*—Thomas J. Brahan

*Attorney, Agent, or Firm*—Charles C. Garvey

[57] ABSTRACT

A method and apparatus for the mounting of lift cranes on jackup rigs, offshore platforms, and like offshore structures provides a first static bearing race portion which is mounted upon the jacking structure, for example, of a jackup rig surrounding the telescoping leg associated therewith. On offshore platforms, a vertical leg portion of the jacket can be extended vertically with the static bearing race portion being affixed to the extended vertical jacket leg. A second movable bearing race portion is attached to the static race portion with a plurality of bearings therebetween allowing the first and second bearing race portions to rotate with respect to one another. The crane is then supported on the upper bearing race portion with the telescoping leg of the jackup rig or offshore jacket structure passing through both bearing race portions, the crane structure unencumbering vertical movement of the leg in the case of a jackup rig.

15 Claims, 6 Drawing Figures

METHOD AND APPARATUS FOR MOUNTING LIFT CRANE ON OFFSHORE STRUCTURES

BACKGROUND OF THE INVENTION

1. Technical Field

The present invention relates to cranes and crane structures, and more particularly to the mounting of crane structures on offshore drilling platforms and rigs such as jackup rigs and the like. Even more particularly, the present invention relates to a method and apparatus for the mounting of a crane upon a jackup rig or offshore structure.

2. General Background

In the drilling of offshore oil wells for oil and gas, one of the methods used is to provide a working platform that is jacked up above the surface of the water having three or more legs implanted upon the sea floor. The use of such rigs is known in the art and they are known by various terms such as "jackup rigs" due to the use of a jacking system which usually involves a rack and pinion mechanism to elevate the barge with respect to the legs. Generally the legs for such a jackup unit consist of, for example, a cylindrical elongated tubular member having along its longitudinal axis an external rack. This rack cooperates with a jacking structure providing a powered pinion gear which rotates and causes the rack upon the leg to linearly move with respect to the barge thus raising or lowering the rig barge structure as desired. A jack frame is provided with is structurally connected to the barge or deck portion of the jackup rig and the pinion gear and its associated rotational power is affixed to this frame which necessarily is quite strong structurally being reinforced with the necessary structural steel beams or the like in order to properly transfer the load from the leg through the jacking mechanism including the pinion gear and the jack frame to its point of support upon the barge or rig floor.

Because of the high loads being transferred from the barge or rig deck to the legs, the jacking structure including the frame, the pinion gear and the motors are quite strong structurally and would adequately support a crane with minimum reinforcement. At any rate, to structurally reinforce the jacking frame with the necessary beams, gusset plate, and the like in order to support a crane of a given weight would be no problem once the weight of the crane was known as well as the weights it would be lifting and like such parameters.

It would be desirable to mount the lift crane which is necessary for lifting items on a jackup rig above the jacking structure and surrounding the leg of the crane. In this manner, vital space on the deck would be left available for other uses while the space above the jacking structure which normally would be free of anything would be a location for the lift crane when following the teaching of the present invention.

Besides the space saving features of the present invention, the mounting of a lift crane above the jacking structure and surrounding the leg provides additional safety in that the leg itself acts as a structural support in the event of bearing failure with the crane tipping a short distance before the leg catches it.

3. General Discussion of the Present Invention

The present invention thus provides a method and apparatus for the mounting of a lift crane on a jackup barge, rig, or the like which thus saves valuable rig floor space as well as attaches the crane in a safe manner which prevents its catastrophic failure upon a failure of the main crane support bearing.

The present invention provides a method for the mounting of a lift crane on a jackup rig. A first static bearing race portion is affixed to the jackup rig atop one of the rig jacking structures and surrounding the telescoping leg associated therewith. A second movable bearing race portion is affixed to the static race portion with a plurality of ball bearings therebetween allowing the first and second bearing race portions to rotate with respect to one another. A crane structure is then supported on the upper race portion with the telescoping leg of the jackup rig passing through both bearing race portions, with the crane structure unencumbering vertical movement of the leg. Thus, it is an object of the present invention to provide a method and apparatus for the mounting of a lift crane on, for example, a jackup rig which saves valuable deck space on the jackup rig while adequately supporting the crane structure.

It is another object of the present invention to provide a method for mounting a crane upon a jackup leg which utilizes the telescoping leg portion of the rig to support the crane in the event of a bearing failure.

Another object of the present invention is to provide a lift crane for use with jackup rigs and offshore platforms which can be easily adapted to existing structures.

Another object of the present invention is to provide a lift crane for use with offshore structures such as jackup rigs, offshore platforms and the like which utilizes as its structural support a portion of the offshore platform in a way which allows a smooth rotational bearing to support the crane yet prevents catastrophic failure in the event of bearing failure by utilizing a portion of the offshore structure to hold the crane in the event a bearing fails.

Another object of the present invention is to provide a crane apparatus and method of saving the expense of a substantial construction portion of the crane pedestal foundation by utilizing existing rig support at the jacking structure.

A feature of the present invention is the elimination of unnecessary weight and expense normally associated with the crane pedestal foundation by using existing structural elements of the jackup rig.

BRIEF DESCRIPTION OF THE DRAWINGS

For a further understanding of the nature and objects of the present invention, reference should be had to the following detailed description, taken in conjunction with the accompanying drawings, in which like parts are given like reference numerals and wherein.

DETAILED DESCRIPTION OF THE PREFERRED EMBODIMENT

Figure 1:
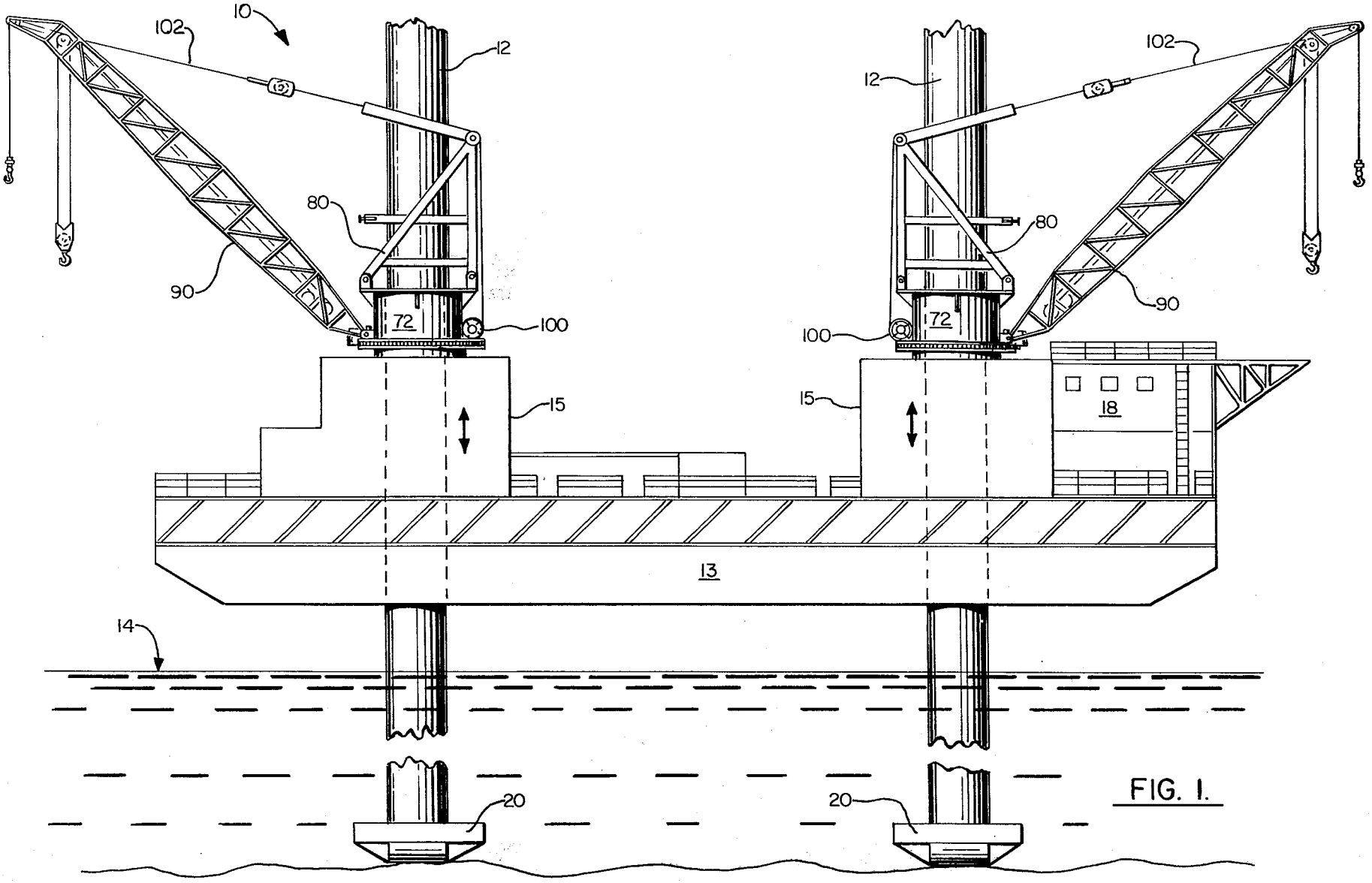
FIG. 1 is a schematic elevational view of the preferred embodiment of the apparatus of the present invention shown in use on an offshore platform such as a jackup rig.

FIG. 1 best illustrates the preferred embodiment of the apparatus of the present invention designated generally by the numeral 10. In FIG. 1 there can be seen crane structure 10 mounted upon a jackup rig which is designated by the numeral 11.

Referring now to FIG. 1, the numeral 13 generally designates a drilling barge platform portion of a jackup rig to which the present invention is applicable. It is supported by a plurality of legs 12, each of which has a longitudinal geared rack (not shown) associated therewith which cooperates with a pinion gear mounted within jacking structure 15. Rotation of the pinion gear moves the leg 12 in a vertical direction to either lower or raise the jackup rig barge 13 portion as desired responsive to a rotation of the pinion gear as it is engaged with the rack. It should be understood that jackup rigs, the use of movable legs, and the use of a jacking structure including the pinion gear and the longitudinal rack on the leg 12 is an old structure well-known in the art and referred to in the art as a "jackup rig".

When the legs 12 are in an uppermost position, the barge 13 portion is of a type which can be floated on a body of water and which can be towed to a desired offshore location where drilling or like is to be performed. A portion of the barge 13 has mounted thereupon crew quarters 18 and other structures necessary for operations.

When barge 11 is being towed to an offshore location, legs 12 will be retracted or raised upwardly with respect to barge 11 such that barge 11 floats in the water upon water surface 14. At such time as the barge 11 reaches the point over which drilling is to be performed or work is to be done, legs 12 are lowered relative to barge 13 such that the base feet 20 of each of the legs 12 contacts the sea bottom 17.

Figure 2:
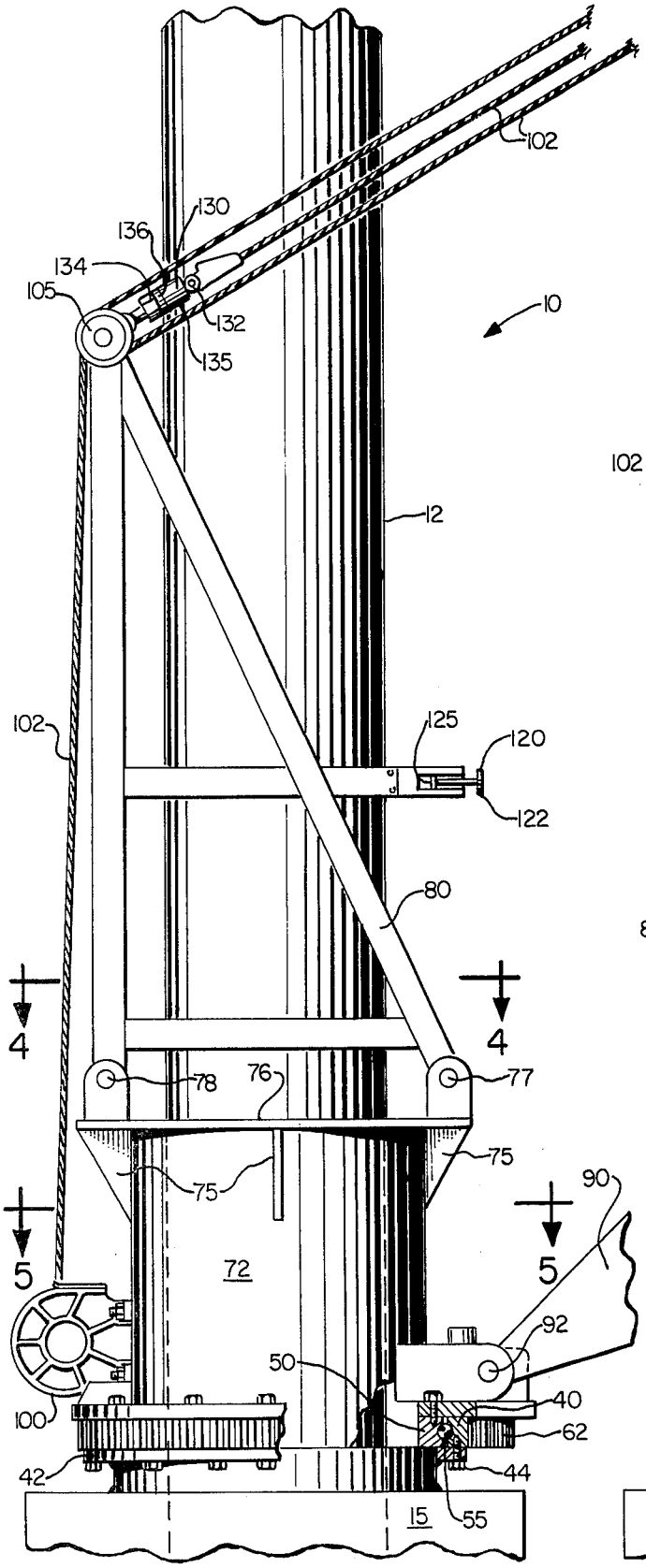
FIG. 2 is a partial side view of the preferred embodiment of the apparatus of the present invention.

As above described, each of the legs 12 is generally tubular in shape and has mounted along one side thereof in a longitudinal or vertical direction a gear rack (not shown), with each gear rack of each leg 12 being arranged for engagement with a pinion gear (not shown) which form part of the jacking assembly which is all structurally reinforced to transmit lifting force from the rack to the pinion gear to the jacking structure and to the deck of barge 13. In FIGS. 1 and 2, the jacking structure is designated generally by the numeral 15. Jacking assemblies 15 provide usually electric motor drives for operating the pinion gears and have brakes associated therewith. The pinion gears can thus operate in either desired direction for either lowering or raising legs 12 relative to each jacking assembly 15 and its connected barge 13.

As will be described more fully hereinafter, the leg 12 upon which crane 10 will be attached extends upwardly in a vertical direction through the crane bearing and through the crane base structure. This acts as a structural safety support in the event of bearing failure. Thus, if the crane bearing were to fail, the entire crane structure 10 would not fall into the sea or below but would be caught after a minimum movement by leg 12 which is of great structural integrity.

Figure 3:
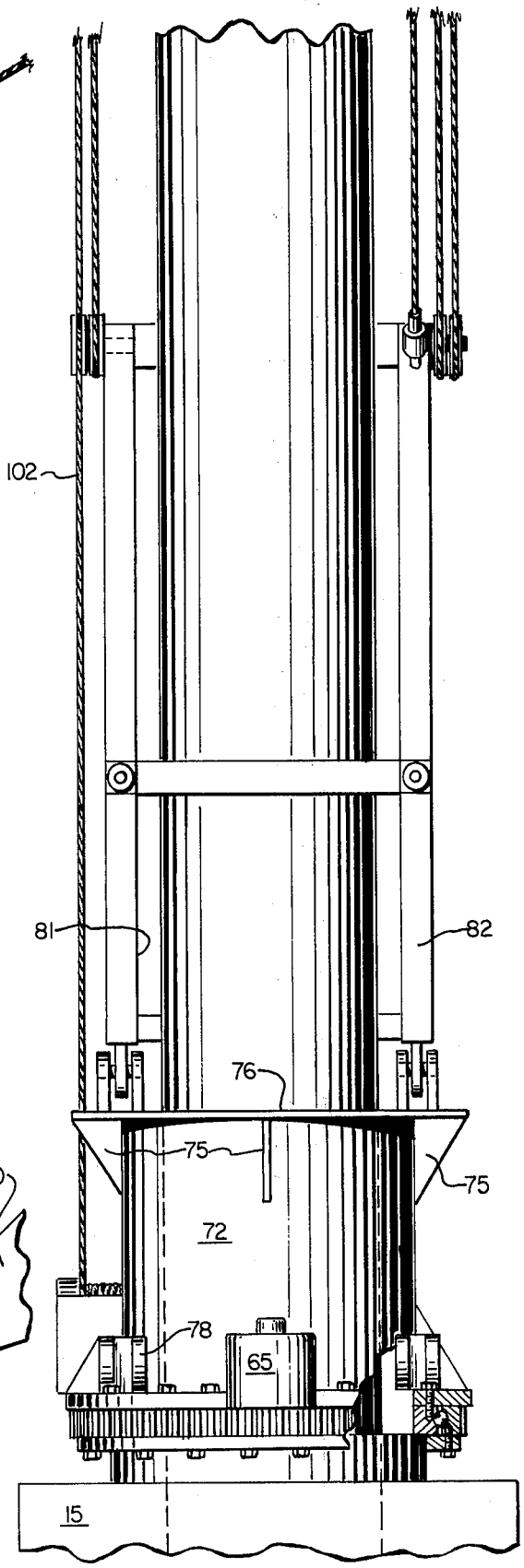
FIG. 3 is a partial front view of the preferred embodiment of the apparatus of the present invention.
Figure 4:
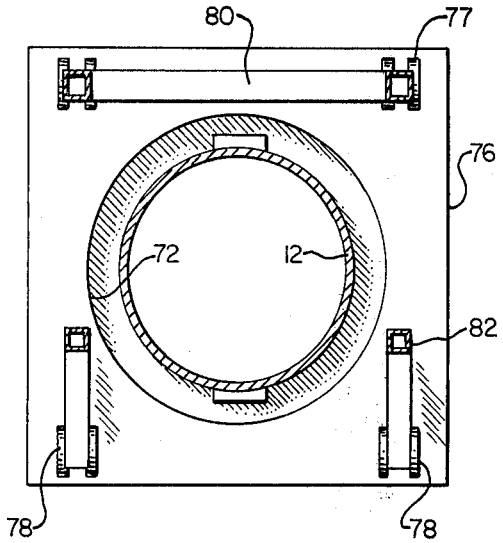
FIG. 4 is a sectional view taken along lines 4—4 of FIG. 2.
Figure 5:
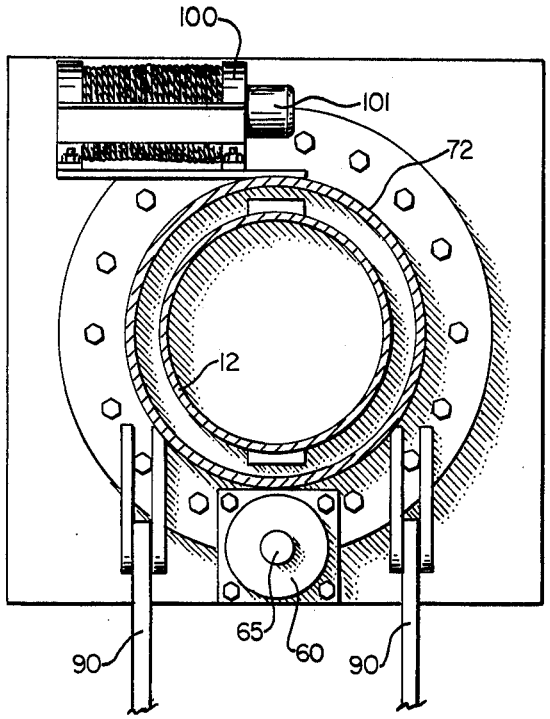
FIG. 5 is a sectional view taken along lines 5—5 of FIG. 2.
Figure 6:
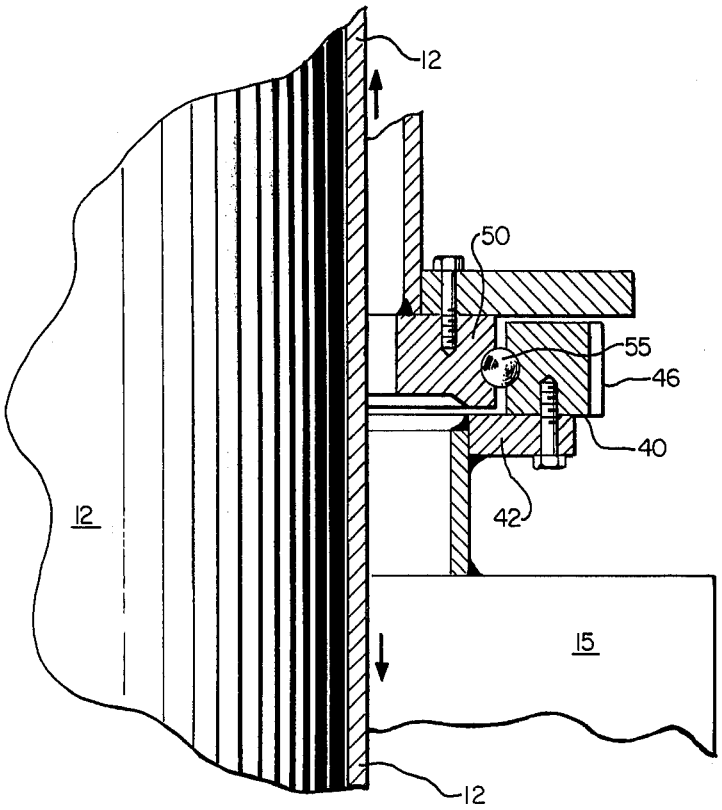
FIG. 6 is a fragmentary sectional view of the preferred embodiment showing the crane support bearing.

FIGS. 3–6 show more particularly the preferred embodiment of the present invention designated generally by the numeral 10. In FIGS. 3, 4, and 6, there can be seen partially the jacking structure 15 of FIG. 1. Mounted thereto is a first static bearing race portion 40 which is attached by bolting, for example, to support flange 42 using a plurality of bolts 44, for example.

Static race portion 40 would preferably be toothed at its periphery providing a plurality of gear receptive teeth 46 which would engage with swing drive assembly 60 as will be described more fully hereinafter. Support flange 42 would be attached to jacking assembly 15 by welding, for example, or like structural connection.

A movable race portion 50 would be attached in a movable fashion to static bearing 40 using, for example, a plurality of ball bearings 55.

Crane superstructure 70 would be affixed to movable bearing race portion 50 by bolting, for example, using bolts 52 as best seen in FIG. 3.

Superstructure 70 would comprise generally a cylindrical sleeve 72 reinforced by means of gusset plate 75 and would have attached at its upper portion a collar 76 which would support gantry 80. Gantry 80 would connect to collar 76 at lugs 77, 78. Boom 90 would pivotally attached at 92 to crane superstructure 70 in a pivotal fashion. Crane 90 would be operated by means of winch 100 which would operate load line 102 to raise and lower boom 90 as desired. Rigging in the form of various pulleys 105–108 would allow boom 90 to be operated by winch 100. Note the use of rigging which would route lift cable 102 up gantry 80 including the left 81 and right 82 frame portions thereof in order to avoid hitting the jackup leg 12. Note that jackup leg 12 passes through the center of crane superstructure 70 as best seen in FIG. 6. Specifically note that legs 12 passes through cylindrical base 72. In the event of a bearing failure, leg 12 would prevent catastrophic failure of crane 10 since leg 12 would retain cylindrical base 72 in the event of a failure of the bearing structure.

A swing drive 60 shown in FIGS. 3, 4, and 5, provides a pinion gear 62 which engages the teeth 46 of race portion 40. Swing drive 60 would provide a motor 65 which is schematically shown in FIGS. 3 and 6, the motor rotating pinion gear 72 in order to move movable race portion 50 with respect to static race portion 40 and thus rotate the crane superstructure 70 about jackup leg 12 as is desirable.

Winch 100 would be operated by a motor 101 as is known in the art.

Safety features including boom stop 120 and sensor 130 can also be seen in FIG. 3. Boom stop 120 provides a tip 122 attached to a pushrod 124 which operates an inner hydraulic cylinder 125. When boom 90 was raised too far, stop 120 would be depressed actuating hydraulic fluid within the chamber of cylinder 125. This cylinder could be used to shift an unloader valve, thus valving the flow of hydraulic fluid to winch 100 and further limiting the raising of boom 90.

Sensor 130 would provide an attachment at 132 to load line 102. A hydraulic cylinder 134 would be attached by means of pushrod 135 to plunger 136. Any excess tension applied to load line 102 would pull pushrod 135 and its associated plunger 136 thus overcoming a desired pressure set within hydraulic cylinder 134. This would in a like manner to stop 120 provide a hydraulic signal which could be interfaced with winch 100 and hault any further lifting of boom 90 as desired.

Boom 10 could be manufactured of any structural material such as structural steel or the like.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A jackup rig crane apparatus comprising:

a. a jackup rig comprising a barge platform supported by a plurality of legs, each of which legs is movable in a vertical direction with respect to the barge;

b. structure means on said barge for raising and lowering each of said legs;

c. a first race portion mounted upon said structure means and providing a central opening, with one of said legs passing through said opening;

d. a second movable race portion mounted upon said static race portion with a plurality of ball bearings therebetween;

e. a crane superstructure mounted upon said movable race portion, said crane superstructure unencumbering vertical movement of said leg.

2. A lift crane support apparatus for use on jackup rigs having a plurality of telescoping legs comprising:

a. a static support base affixed to the jackup rig deck portion adjacent one of the rig telescoping legs;

b. a static bearing race portion having a first central opening connected to said base with said first opening generally centered on the vertical travel path of the telescoping leg about which said static bearing race portion is affixed;

c. a movable bearing race portion having a second opening therethrough and being movably connected to said static race portion, said second opening being generally centered on the vertical travel path of the telescoping leg;

d. a plurality of ball bearings interfaced between said static and said movable race portions; and e. a crane structure affixed to and movable with said movable race.

3. The apparatus of claim 2 wherein said crane structure comprises in part a hollow cylindrical sleeve having an inner space and attached at its lower end portion to said movable race portion.

4. The apparatus of claim 3 further comprising a crane boom supported at least in part by said sleeve.

5. The apparatus of claim 2 wherein said static support base includes a jacking structure on the jackup rig, generally surrounding the telescoping leg associated therewith.

6. The apparatus of claim 4 wherein the telescoping leg of the jackup rig can freely pass during operation through said sleeve at said inner space.

7. A lift crane support apparatus for use on jackup rigs having a barge platform supported by a plurality of telescoping vertically movable legs operated by jacking structures mounted on the barge platform, comprising:

a. a first race portion supported by the barge platform defining an opening so that one of the legs passes therethrough;

b. a second race portion movably mounted on the first race portion;

c. bearing means forming an interface between the first and second race portions for transferring load between the first and second race portions; and d. a crane superstructure mounted upon the movable race portion, the crane superstructure unencumbering vertical movement of the legs.

8. The lift crane support apparatus of claim 7 wherein the first race means comprises a circular body with an opening through which a jackup rig leg passes during operation.

9. The lift crane support assembly of claim 7 further comprising powered swing drive means for rotating the crane superstructure with respect to the barge platform.

10. The lift crane support assembly of claim 7, wherein the crane superstructure comprises in part a cylindrical crane base portion having a diameter larger than the diameter of the telescoping leg so that the leg can freely pass through the cylindrical crane base portion.

11. The lift crane support assembly of claim 7, wherein the bearing means is a ball bearing assembly mounted between the first and second race means.

12. The lift crane support assembly of claim 7, wherein the first race means is positioned about one of the legs and affixed to the jacking structure associated with that leg.

13. The lift crane support assembly of claim 7, wherein the crane superstructure surrounds one of the legs so that the leg can at least partially support the superstructure load in the event of failure of the bearing means.

14. The lift crane support assembly of claim 7, wherein the carne superstructure includes a cylindrical, hollow sleeve, a gantry mounted on the sleeve, and a boom pivotally attached to the sleeve.

15. A lift crane support assembly for use on jackup rigs having a barge platform supported by a plurality of telescoping, vertically movable legs, each operated by an associated jacking structure secured to the barge platform, comprising:

a. a hollow base positioned upon and anchored to one of the jacking structures, and surrounding one of the legs so that the surrounded leg can freely pass therethrough;

b. a crane superstructure attached to the base, the crane superstructure unencumbering vertical movement of the leg.

* * * * *

UNITED STATES PATENT AND TRADEMARK OFFICE

CERTIFICATE OF CORRECTION

PATENT NO. : 4,417,664

DATED : Nov. 29, 1983

INVENTOR(S) : John C. Gordon

It is certified that error appears in the above-identified patent and that said Letters Patent are hereby corrected as shown below:

Column 5, line 15; the first word of that line "static" should be --first--.

Corrected sentence should read as follows:

Claim 1(d): a second movable race portion mounted upon said first race portion with a plurality of ball bearings therebetween;

Signed and Sealed this

*Seventeenth* Day of *April 1984*

[SEAL]

*Attest:*

GERALD J. MOSSINGHOFF

*Attesting Officer*

*Commissioner of Patents and Trademarks*